US009453318B2

(12) United States Patent
Kemp et al.

(10) Patent No.: US 9,453,318 B2
(45) Date of Patent: Sep. 27, 2016

(54) COUPLING ASSEMBLY FOR HELICAL PILE SYSTEM

(71) Applicant: Hubbell Incorporated, Shelton, CT (US)

(72) Inventors: Timothy M. Kemp, Columbia, MO (US); Shawn D. Downey, Columbia, MO (US); Kelly S. Hawkins, Centralia, MO (US)

(73) Assignee: Hubbell Incorporated, Shelton, CT (US)

( * ) Notice: Subject to any disclaimer, the term of this patent is extended or adjusted under 35 U.S.C. 154(b) by 200 days.

(21) Appl. No.: 14/024,908

(22) Filed: Sep. 12, 2013

(65) Prior Publication Data

US 2015/0071712 A1 Mar. 12, 2015

(51) Int. Cl.
*E02D 5/52* (2006.01)
*E02D 5/56* (2006.01)

(52) U.S. Cl.
CPC .. *E02D 5/52* (2013.01); *E02D 5/56* (2013.01)

(58) Field of Classification Search
CPC ..... E02D 5/52; E02D 5/523; E02D 5/526; E02D 5/56; F16B 7/042; F16B 7/0406
USPC ..... 405/250, 251; 403/362, 109.4; 285/90, 285/91, 403, 404, 913
See application file for complete search history.

(56) References Cited

U.S. PATENT DOCUMENTS 12,937 A * 5/1855 Hicks ..... 285/148.13
1,469,304 A * 10/1923 Hughes ..... F16D 1/05 403/305
1,558,334 A * 10/1925 Boss et al. ..... 285/383
1,570,155 A 1/1926 Karbowski
2,270,604 A 1/1942 Roemhild
2,282,073 A 5/1942 McDonald
2,926,028 A * 2/1960 Hookings et al. ..... 285/90
2,935,342 A * 5/1960 Seamark ..... 285/90
4,274,665 A 6/1981 Marsh, Jr.
4,438,954 A * 3/1984 Hattori ..... 285/104
7,146,704 B2 12/2006 Otten
7,452,004 B2 11/2008 Hayakawa
7,488,257 B1 * 2/2009 Booker ..... F16D 3/06 403/359.1
2002/0117854 A1 8/2002 Thermos
2003/0075923 A1 4/2003 Lepoutre (Continued)

FOREIGN PATENT DOCUMENTS

DE 3121602 * 12/1982
JP 56129515 a * 10/1981
JP 11021882 A 1/1991

(Continued)

*Primary Examiner* — Sunil Singh
(74) *Attorney, Agent, or Firm* — Michael Best & Friedrich, LLP

(57) ABSTRACT

A coupling assembly for connecting first and second members of a helical pile system. A coupling member has a first opening at a first end and a second opening at a second end. A hollow protrusion extends outwardly from and axially along the outer surface of the coupling member. A fastener opening is disposed in the coupling member. A first member is fixedly receivable by the first opening of the coupling member. A second member has a rib disposed on an outer surface. The rib is receivable by the protrusion when the second member is received by the second opening of the coupling member. A fastener is receivable in the fastener opening. The fastener prevents withdrawal of the second member after being inserted in the coupling member.

29 Claims, 14 Drawing Sheets

(56) References Cited

U.S. PATENT DOCUMENTS

| | | | | |
|---|---|---|---|---|
| 2004/0028481 | A1* | 2/2004 | Pinkleton | 405/259.1 |
| 2012/0114425 | A1 | 5/2012 | Seider | |

FOREIGN PATENT DOCUMENTS

| | | | |
|---|---|---|---|
| JP | 2003090035 | A | 3/2003 |
| JP | 2011247056 | A | 12/2011 |

* cited by examiner

COUPLING ASSEMBLY FOR HELICAL PILE SYSTEM

FIELD OF THE INVENTION

The present invention relates to a coupling assembly in which first and second components are quickly and easily connected. More particularly, the present invention relates to a helical pile system including a coupling member for securing first and second members. Still more particularly, the present invention relates to a helical pile system including a coupling member that transfers loads from a first member to a second member.

BACKGROUND OF THE INVENTION

A pipe anchor or helical or screw pile is used as a building foundation. The helical pile is driven into the ground and carries the structure's load. Helical bearing plates connected to the shaft of the helical pile transfer the load to the soil. A drive tool connects the helical pile to a powered drive head to drive the helical pile into the ground.

Fastener holes are disposed at ends of members of a helical pile system to facilitate connecting adjacent members together. Fasteners are inserted radially through the fastener holes to secure the adjacent members together. Thus, tension, compression and torque of the helical pile system is transferred from one member to an adjacent member is transferred solely through the fasteners. The fasteners limit the amount of torque that can be transferred through the helical pile system. Accordingly, a need exists for a coupling assembly in which an increased amount of torque can be transferred through a helical pile system.

Another disadvantage of such coupling is the difficulty associated with aligning the fastener holes such that fasteners can be inserted therein. The helical pile system members can be large and unwieldy, increasing the difficulty of aligning the fastener holes. Additionally, the helical pile system members can have circular cross sections, further increasing alignment difficulty. The lack of a stop member in helical pile system members increases the difficulty of bringing the two members together for alignment. Accordingly, a need exists for a coupling assembly in which helical pile system members are quickly and easily aligned and connected.

The fasteners extend radially inwardly, thereby reducing the inner diameter of the helical pile system members. Helical pile systems often have hollow members such that components can extend or be conveyed through the inner diameter of the system. However, the fasteners reduce this inner diameter such that components cannot be extended or conveyed through the hollow members of a helical pile system. Accordingly, a need exists for a coupling assembly in which an inner diameter of members of the helical pile system is not reduced.

The bulky coupling of the helical pile system members using fasteners causes an increased soil disturbance as the helical pile system members are driven through soil. The increased soil disturbance results in larger skin friction, thereby reducing the depth to which the helical pile system can be driven. Accordingly, a need exists for a coupling assembly having a low profile to minimize soil disturbance.

SUMMARY OF THE INVENTION

Accordingly, a primary objective of the present invention is to provide an improved coupling assembly for connecting first and second members of a helical pile system.

A further objective of the present invention is to provide an improved coupling assembly for a helical pile system in which a coupling member quickly and easily connects first and second members.

A further objective of the present invention is to provide an improved coupling assembly that facilitates load transfer from a first member to a second member.

A still further objective of the present invention it to provide an improved coupling assembly that does not substantially reduce an inner diameter of first and second members being connected.

A still further objective of the present invention is to provide an improved coupling assembly that minimizes soil disturbance as helical pile system members are driven through soil.

The foregoing objectives are basically attained by a coupling assembly for connecting first and second members of a helical pile system. A coupling member has a first opening at a first end and a second opening at a second end. A hollow protrusion extends outwardly from and axially along the outer surface of the coupling member. A fastener opening is disposed in the coupling member. A first member is fixedly receivable by the first opening of the coupling member. A second member has a rib disposed on an outer surface. The rib is receivable by the protrusion when the second member is received by the second opening of the coupling member. A fastener is receivable in the fastener opening. The fastener prevents withdrawal of the second member after being inserted in the coupling member.

The foregoing objectives are also basically attained by a coupling assembly for a helical pile system. A coupling member has a first opening and a second opening. A hollow protrusion extends outwardly from and axially along the outer surface of the coupling member. A fastener opening is disposed in the protrusion of the coupling member. A first member is fixedly received by the first opening of the coupling member. A second member is received by the second opening of the coupling member. A rib is disposed on an outer surface of the second member and received by the protrusion of the coupling member. A fastener is received by the fastener opening. The fastener is disposed axially rearwardly of the second member to prevent withdrawal of the second member from the coupling member.

The foregoing objectives are also basically attained by a method of connecting first and second members of a helical pile system. The first member is inserted in a coupling member. A rib of the second member is aligned with a protrusion of the coupling member and the second member is inserted in the coupling member. The second member is locked in the coupling member with a fastener that is disposed axially rearwardly of the rib to prevent removal of the second member.

Other objects, advantages and salient features of the invention will become apparent from the following detailed description, which, taken in conjunction with the annexed drawings, discloses preferred embodiments of the invention.

As used in this application, the terms "front," "rear," "upper," "lower," "upwardly," "downwardly," and other orientational descriptors are intended to facilitate the description of the exemplary embodiments of the present invention, and are not intended to limit the structure thereof to any particular position or orientation.

BRIEF DESCRIPTION OF THE DRAWINGS

The above aspects and features of the present invention will be more apparent from the description for exemplary embodiments of the present invention taken with reference to the accompanying drawings, in which.

Throughout the drawings, like reference numerals will be understood to refer to like parts, components and structures.

DETAILED DESCRIPTION OF EXEMPLARY EMBODIMENTS

Figure 1:
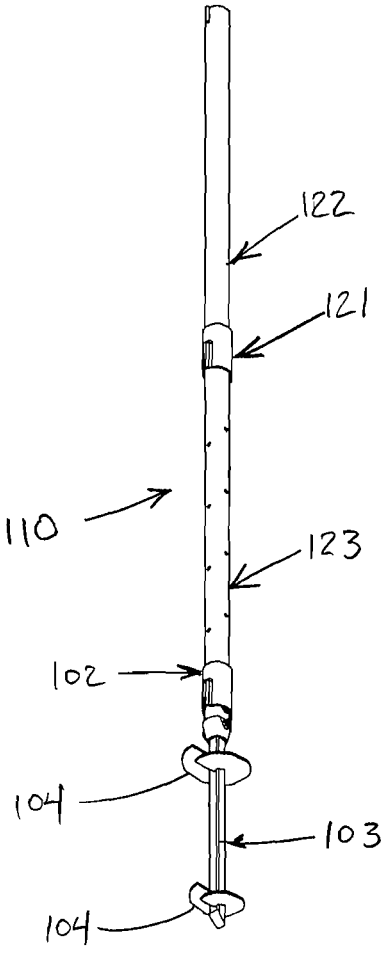
FIG. 1 is a perspective view of a helical pile system in accordance with an exemplary embodiment of the present invention.
Figure 2:
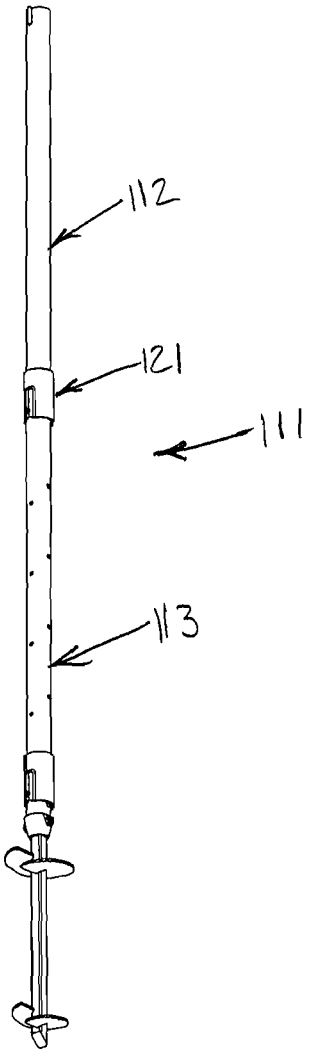
FIG. 2 is an perspective view of another helical pile system in which longer piles are used.
Figure 4:
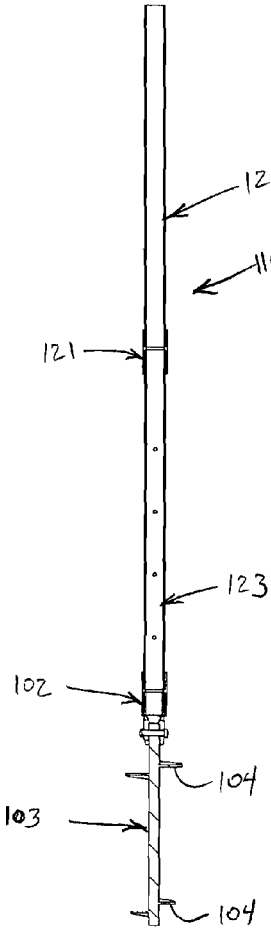
FIG. 4 is a side elevational view in cross-section taken along line 4-4 of the pile system of FIG. 3.
Figure 3:
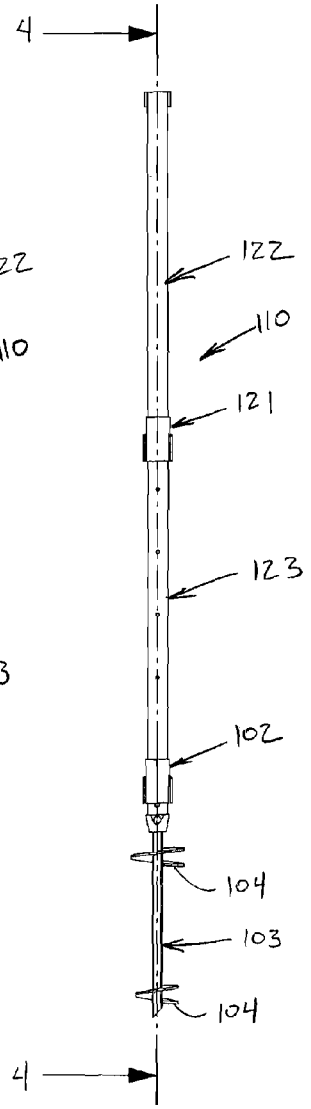
FIG. 3 is a front elevational view of the pile system of FIG. 1.
Figure 6:
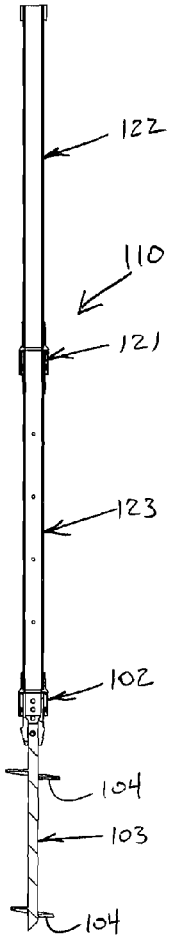
FIG. 6 is a front elevational view in cross-section taken along line 6-6 of the pile system of FIG. 5.
Figure 5:
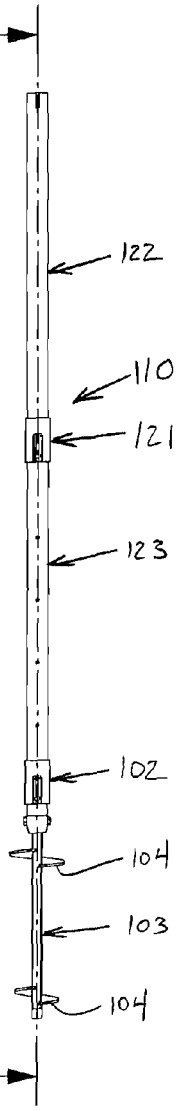
FIG. 5 is a side elevational view of the pile system of FIG. 1.

As shown in FIGS. 1 and 2, helical pile systems 110 and 111 in accordance with exemplary embodiments of the present invention include a coupling member 121 for connecting first members 122 and 112 and second members 123 and 113 of the helical pile systems 110 and 111. The helical pile systems 110 and 111 are substantially identical with the exception that first and second members 112 and 113 of FIG. 2 are longer than first and second members 122 and 123 of FIG. 1. The coupling assembly of the present invention is described below with reference to circular cylindrical helical pile members, although the adapter may be configured for use with any shape or length helical pile member.

As shown in FIGS. 1 and 3-6, a first coupling member 121 connects first and second members 122 and 123 of the helical pile system 110. A second coupling member 102 connects the second member 123 with a third member 103. A plurality of helical screws 104 are connected to the third member 103. The helical screws 104 are preferably welded to the third member 103. As shown in FIG. 2, the third member 103 has a substantially rectangular cross-section with rounded corners, although the third member 103 can have any suitable shape and size.

A coupling assembly 20 in accordance with a first exemplary embodiment of the present invention is shown in FIGS. 7-27. The coupling assembly 20 includes a coupling member 21 connecting first and second members 22 and 23 of a helical pile system 110 (FIGS. 1 and 3-6).

Figure 13:
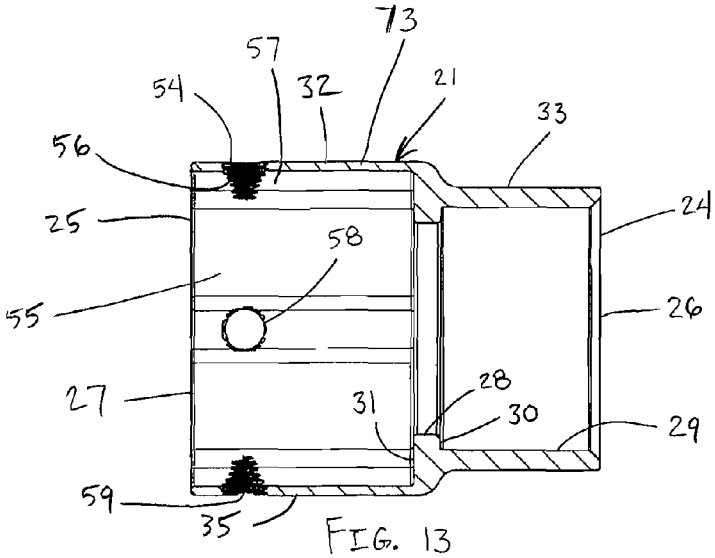
FIG. 13 is a side elevational view in cross-section taken along line 13-13 of the coupling member of FIG. 12.

The coupling member 21, as shown in FIGS. 12-15, has a first end 24 and a second end 25. A first opening 26 is formed at the first end 24 for fixedly receiving the first member 22. A second opening 27 is formed at the second end 25 for receiving the second member 23. A wall 73 having an inner surface 29 and an outer surface 33 extends from the first end 24 to the second end 25 to form a passage 55 therethrough. A shelf 28 extends radially inwardly from the inner surface 29 of the coupling member to form a first shoulder 30 facing the first end 24 and a second shoulder 31 facing the second end 25, as shown in FIG. 13.

Figure 15:
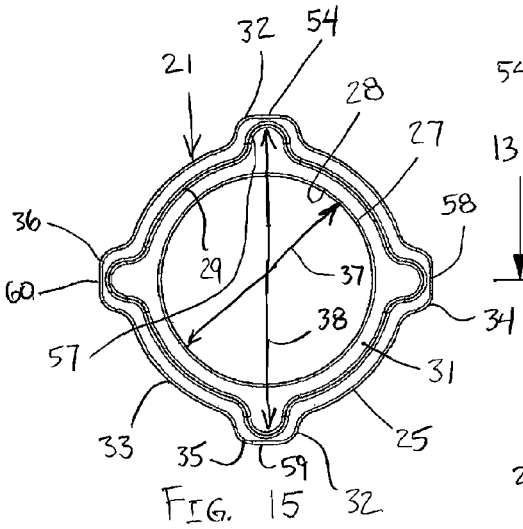
FIG. 15 is an end elevational view of the coupling member of FIG. 12.
Figure 12:
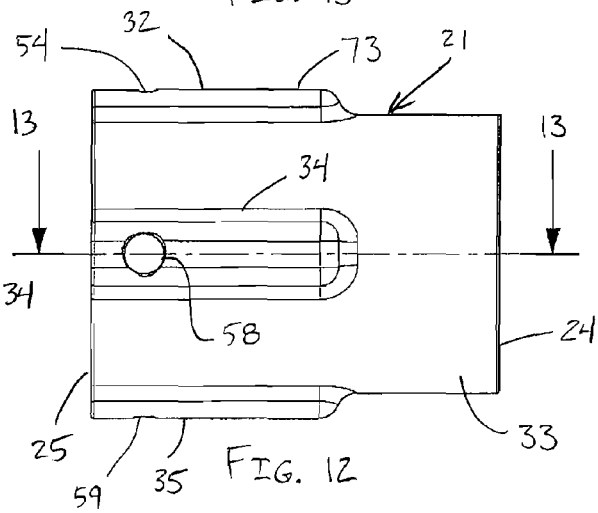
FIG. 12 is a front elevational view of the coupling member of FIG. 7.
Figure 14:
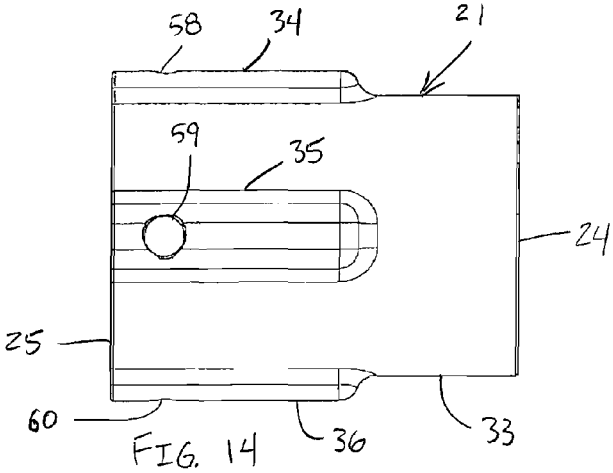
FIG. 14 is a side elevational view of the coupling member of FIG. 12 rotated 90 degrees about a longitudinal axis.

A hollow protrusion 32 extends outwardly from an outer surface 33 of the coupling member 21 and extends axially from the second end 27 to a position proximate the shelf 28, as shown in FIGS. 12, 14 and 15. Four protrusions 32, 34, 35 and 36 are equally spaced around the circumference of the coupling member, as shown in FIG. 15. An inner diameter 37 between the inner surface 29 of the coupling member 21 is less than an inner diameter 38 between opposite protrusions 32 and 35, as shown in FIG. 15.

A fastener opening 54 is disposed in the protrusion 32, as shown in FIGS. 12 and 13. The fastener opening 54 extends entirely through the wall 73 such that an end of a fastener inserted therein is disposed in the passage 55. The fastener opening 54 is preferably threaded such that threads 56 extend through inner side surfaces 57 of the protrusion. Substantially similar fastener openings 58, 59 and 60 are formed in each of the other protrusions 34, 35 and 36, respectively.

Figure 17:
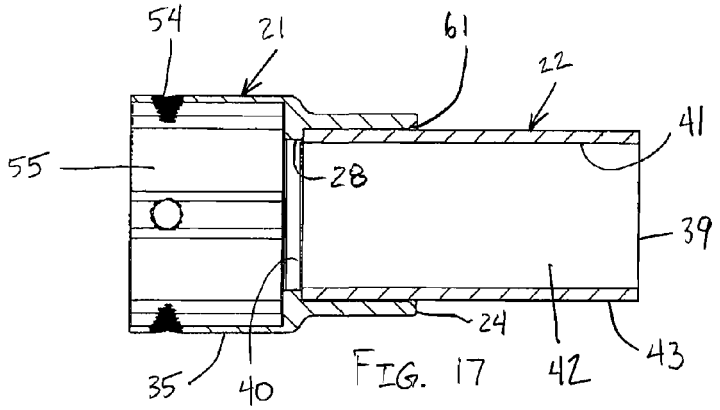
FIG. 17 is a side elevational view in cross-section taken along line 17-17 of the coupling member and first member of FIG. 16.
Figure 19:
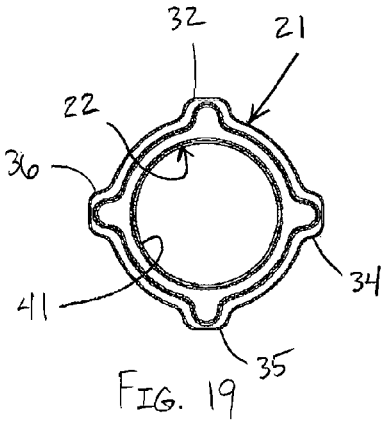
FIG. 19 is an end elevational view of the coupling member and first member of FIG. 16.
Figure 16:
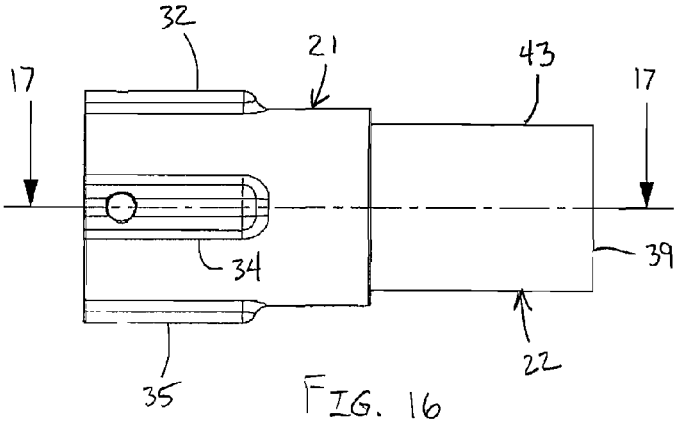
FIG. 16 is a front elevational view of the coupling member connected to the first member of FIG. 7.
Figure 18:
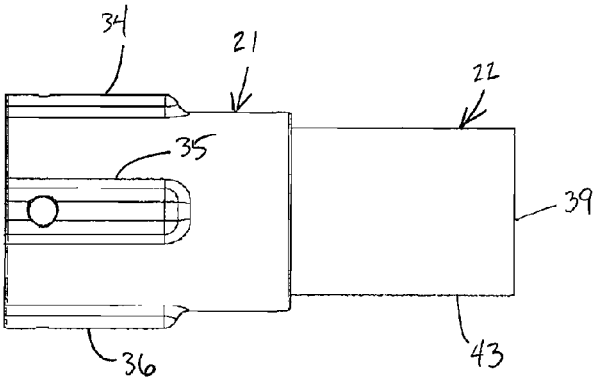
FIG. 18 is a side elevational view of the coupling member and first member of FIG. 16 rotated 90 degrees about a longitudinal axis.

The first member 22, as shown in FIGS. 16-19, has a first end 39, a second end 40 and an outer surface 43 extending therebetween. As shown in FIG. 17, the first member 22 is preferably a hollow member. An inner surface 41 extends from the first end 39 to the second end 40 to form a passage 42 through the first member 22.

Figure 21:
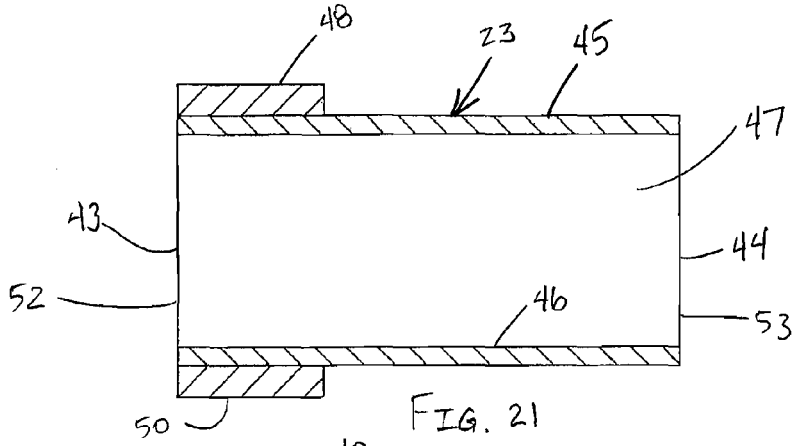
FIG. 21 is a side elevational view in cross-section taken along line 21-21 of the second member of FIG. 20.

The second member 23, as shown in FIGS. 20-23, has a first end 43, a second end 44 and an outer surface 45 extending therebetween. As shown in FIG. 21, the second member 23 is preferably a hollow member. An inner surface 46 extends from a first opening 52 at the first end 43 to a second opening 53 at the second end 44 to form a passage 47 through the second member.

Figure 23:
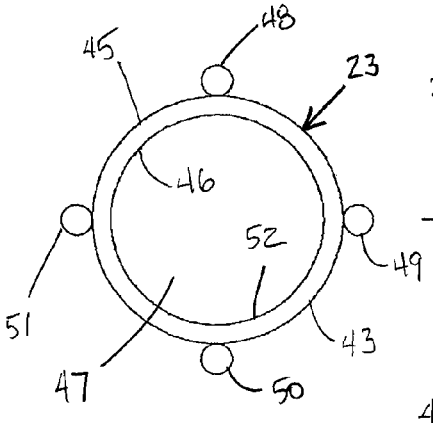
FIG. 23 is an end elevational view of the second member of FIG. 20.
Figure 20:
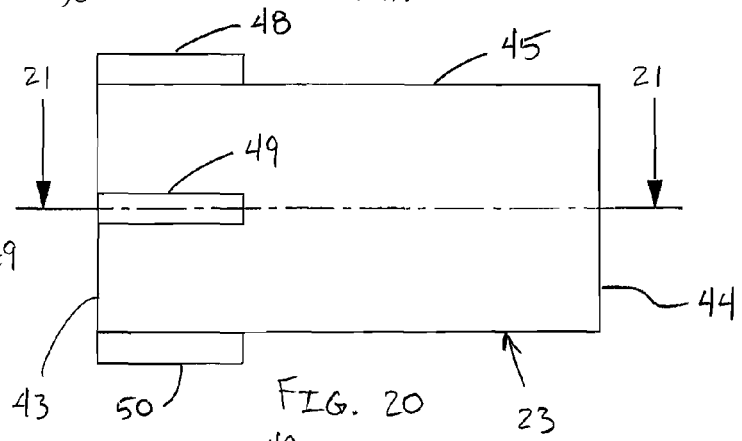
FIG. 20 is a front elevational view of the second member of FIG. 7.
Figure 22:
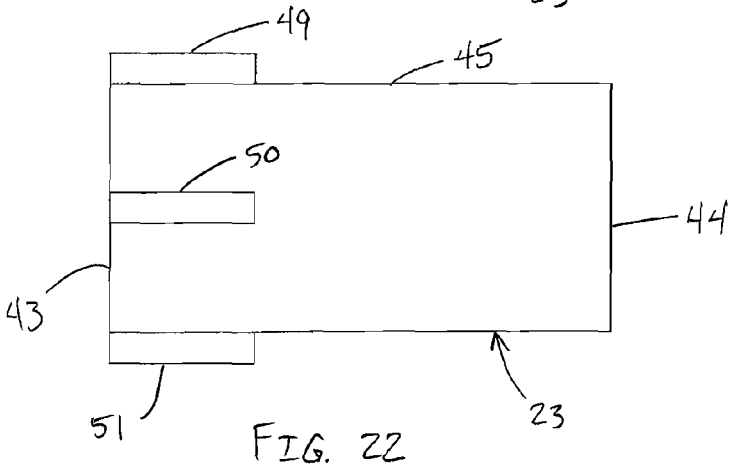
FIG. 22 is a side elevational view of the second member of FIG. 20 rotated 90 degrees about a longitudinal axis.
Figure 25:
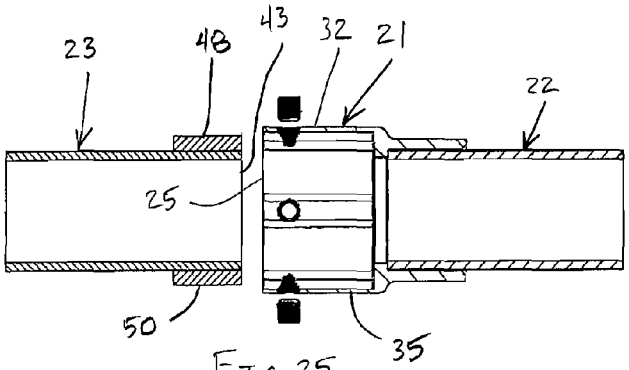
FIG. 25 is a side elevational view in cross-section taken along line 25-25 of the coupling member prior to receiving the second member of FIG. 24.
Figure 27:
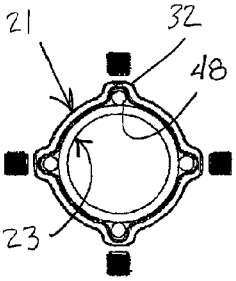
FIG. 27 is an end elevational view of the coupling member prior to receiving the second member of FIG. 20.
Figure 24:
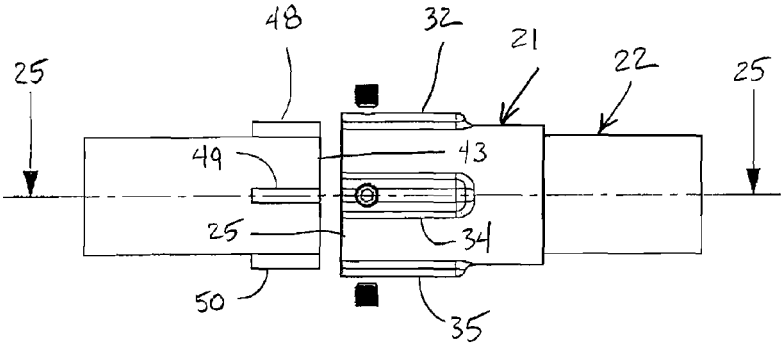
FIG. 24 is a front elevational view of the coupling member prior to receiving the second member.
Figure 26:
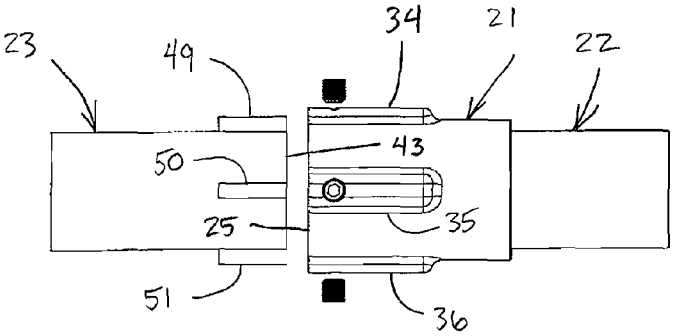
FIG. 26 is a side elevational view of the coupling member prior to receiving the second member of FIG. 24 rotated 90 degrees about a longitudinal axis.

A first rib 48 is disposed on an outer surface 45 of the second member. The first rib 48 extends from the first end 43 axially along the outer surface 45 toward the second end 44. Four ribs 48, 49, 50 and 51 are equally spaced around the circumference of the second member 23, as shown in FIG. 23. The ribs 48-51 are preferably welded to the second member 23 to securely fix the ribs to the second member, although the ribs can be connected in any suitable manner.

The coupling member 21 is preferably made of a metal, such as steel. The first and second members 22 and 23 are typically made of steel. Preferably, the coupling member 21 is made of the same material as the first and second members 22 and 23.

Assembly and Operation

The coupling assembly 20 in accordance with the first exemplary embodiment of the present invention provides a quick and easy connection between first and second members 22 and 23, as shown in FIGS. 8-11.

Figure 9:
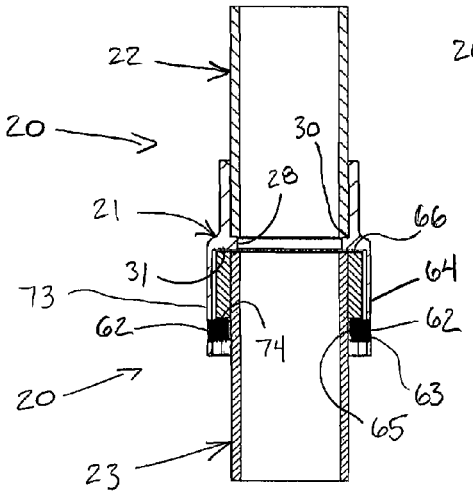
FIG. 9 is a side elevational view in cross-section taken along line 9-9 of the coupling member assembly of FIG. 8.
Figure 8:
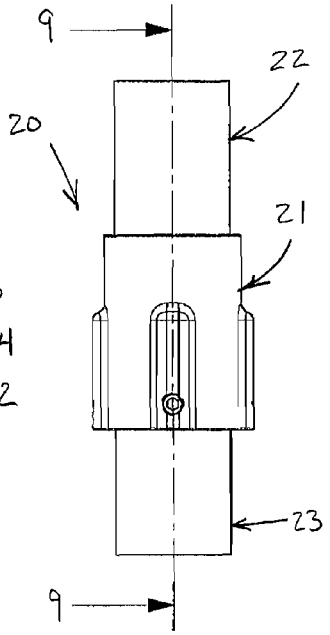
FIG. 8 is a front elevational view of the coupling member assembly of FIG. 7.
Figure 10:
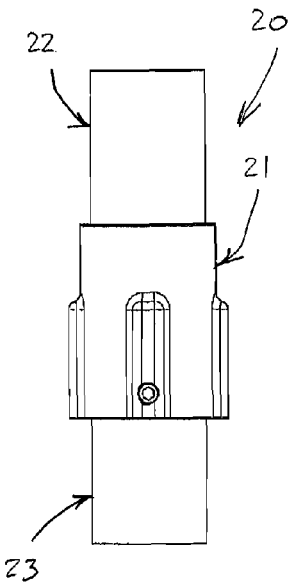
FIG. 10 is a side elevational view of the coupling member assembly of FIG. 8 rotated 90 degrees about a longitudinal axis.
Figure 11:
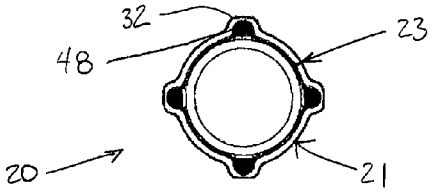
FIG. 11 is a bottom plan view of the coupling member assembly of FIG. 7.

The second end 40 of the first member 22 is inserted in the first opening 26 in the first end 24 of the coupling member 21, as shown in FIGS. 16-19. The first member 22 is inserted in the coupling member 21 until the first end 40 abuts the first shoulder 30 of the coupling member 21, thereby preventing further insertion of the first member 22. A bevel 61 is formed at the first end 24 of the coupling member, as shown in FIG. 17, to facilitate welding the first member 22 to the coupling member 21. As shown in FIGS. 9 and 17, an inner diameter of the shelf 28 is preferably larger than an inner diameter of the first member 22 such that the coupling member 21 does not obstruct any components being passed through the first member 22 and the coupling member 21.

The first end 43 of the second member 23 is aligned with the second end 25 of the coupling member 21, as shown in FIGS. 24-27. The second member 23 is positioned such that the ribs 48-51 are aligned with protrusions 32 and 34-36 of the coupling member 21. Each rib is aligned with one of the protrusions to facilitate insertion of the second member 23 in the coupling member 21.

The first end 43 of the second member 23 is inserted in the second opening 27 in the second end 25 of the coupling member 21, as shown in FIGS. 8-11. The second member 23 is inserted in the coupling member 21 until the first end 43 abuts the second shoulder 31 of the coupling member 21, thereby preventing further insertion of the second member 23. As shown in FIG. 9, the inner diameter of the shelf 28 is preferably larger than an inner diameter of the second member 23 such that the coupling member 21 does not obstruct any components being passed through the second member 23 and the coupling member 21.

Figure 7:
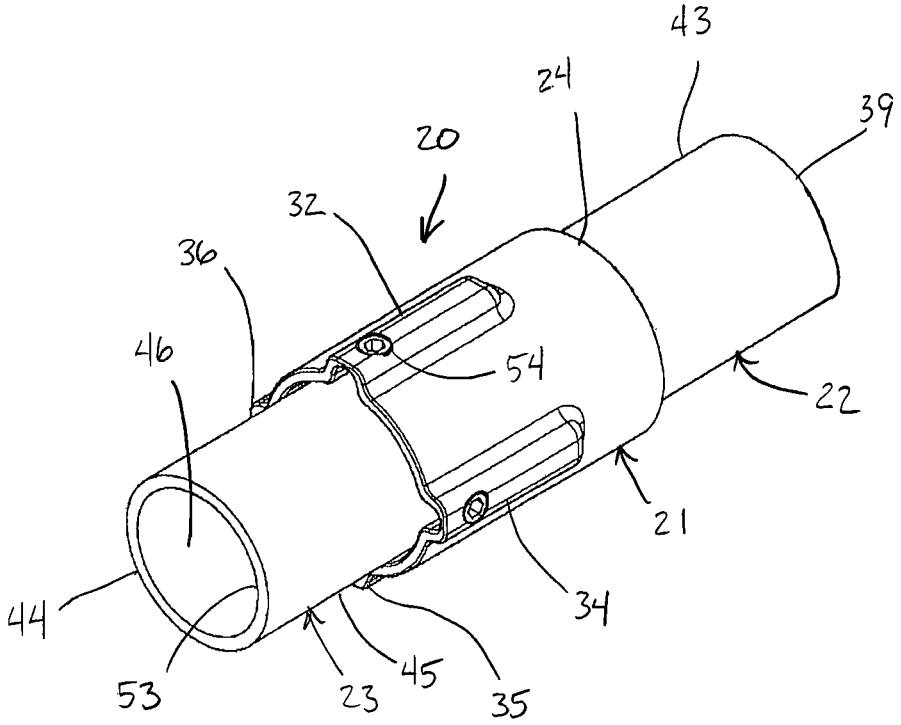
FIG. 7 is a perspective view of a coupling member assembly in accordance with a first exemplary embodiment of the present invention connecting first and second members.

A fastener 62 is disposed in each of the fastener openings 54 and 58-60 of the protrusions 32 and 34-36, as shown in FIGS. 8-11, to securely lock the second member 23 in the coupling member 21. The fasteners 62 are substantially identical. Any suitable fastener can be used, such as a set screw or bolt. An outer end 63 of the fastener 62 is preferably flush with an outer surface 64 of the protrusion 32, as shown in FIGS. 7 and 9. A low profile coupling assembly 20 is provided by not extending the outer end 63 of the fastener 62 beyond the outer surface 64 of the protrusions, thereby minimizing soil disturbance when installing a helical pile system in the ground. Alternatively, an outer end of the fastener, such as a bolt, can extend beyond the outer surface of the protrusions to increase soil disturbance when necessary or when soil disturbance is not an issue. Additionally, using a bolt as the fastener increases the tension strength of the coupling assembly 20. As shown in FIG. 13, the threads 56 of each fastener opening extend into the side surfaces 57 of the protrusions to reduce bending stress on the inserted fastener, thereby increasing the strength of the coupling assembly when the first and second members 22 and 23 are in tension.

An inner end 65 of the fastener 62 extends radially inwardly and against an axial end 74 of the rib remote from an end 66 of the rib inserted in the coupling member 21, thereby preventing withdrawal of the second member 23, as shown in FIG. 9. Accordingly, the fasteners only bear the relatively small forces to prevent separation of the second member 23 and the coupling member 21. Axial compressive and torque loads are borne by the interaction of the shoulders 30 and 31 of the coupling member 21 with the first and second members 22 and 23. The inner diameter of the shelf 28 is greater than inner diameters of the first and second members 22 and 23 such that components can be passed through the coupling assembly 20 without interference from the coupling member 21 or fasteners 62. As shown in FIGS. 1-6, a plurality of coupling assemblies can be used in helical pile systems 110 and 111 to couple members together.

During installation, torque is transferred from the first member 22 to the coupling member 21, and from the coupling member 21 to the second member 23 through the connection between the protrusions and ribs. Thus, torque is not transferred through fasteners and fastener holes that reduce torque capacity as in conventional coupling assemblies used in helical pile systems. Increased torque capabilities are obtained through the coupling assembly 20 of the present invention. Additionally, the ribs and protrusions are disposed at a greater distance (than the outer surfaces of the second member) from the center of rotation, thereby allowing for greater torque transfer. Compression is transferred directly through the first and second members 22 and 23 and the coupling member 21 by abutting the first and second members with the internal shoulders 30 and 31 of the coupling member, thereby improving the compressive load transfer. The ends of the first and second members 22 and 23 are disposed within the coupling member 21, thereby providing stiffness to the coupling assembly 20 to substantially resist buckling.

Second Exemplary Embodiment

A coupling assembly 120 in accordance with a second exemplary embodiment of the present invention is shown in FIGS. 28-49. The coupling assembly 120 includes a coupling member 121 connecting first and second members 122 and 123 of a helical pile system 110, as shown in FIGS. 1, 3-6 and 28.

Figure 34:
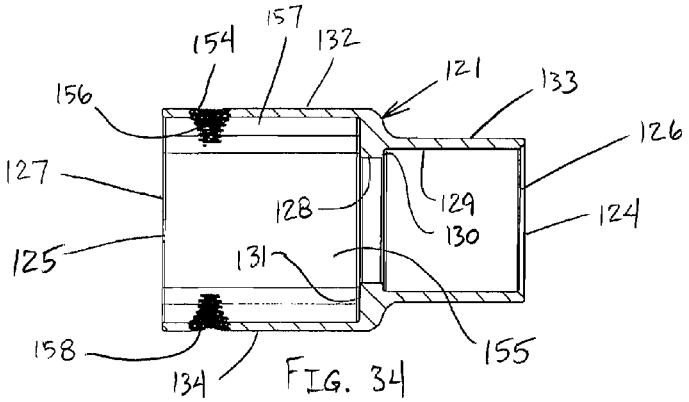
FIG. 34 is a side elevational view in cross-section taken along line 34-34 of the coupling member of FIG. 33.

The coupling member 121, as shown in FIGS. 33-37, has a first end 124 and a second end 125. A first opening 126 is formed at the first end 124 for fixedly receiving the first member 122. A second opening 127 is formed at the second end 125 for receiving the second member 123. A wall 173 having an inner surface 129 and an outer surface 133 extends from the first end 124 to the second end 125 to form a passage 155 therethrough. A shelf 128 extends radially inwardly from the inner surface 129 of the coupling member 121 to form a first shoulder 130 facing the first end 124 and a second shoulder 131 facing the second end 125, as shown in FIG. 34.

Figure 36:
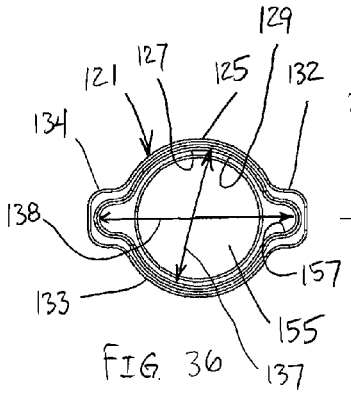
FIG. 36 is a left end elevational view of the coupling member of FIG. 33.
Figure 33:
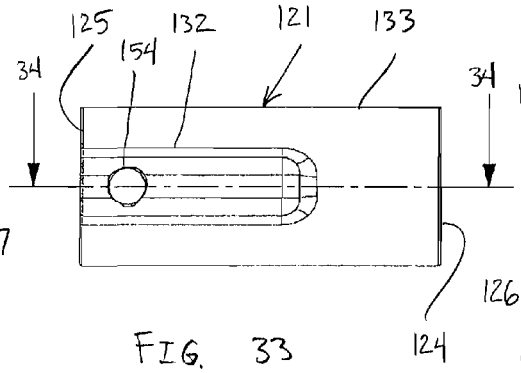
FIG. 33 is a front elevational view of the coupling member of FIG. 28.
Figure 37:
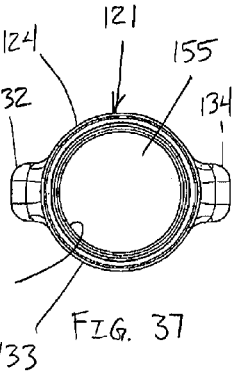
FIG. 37 is a right end elevational view of the coupling member of FIG. 33.
Figure 35:
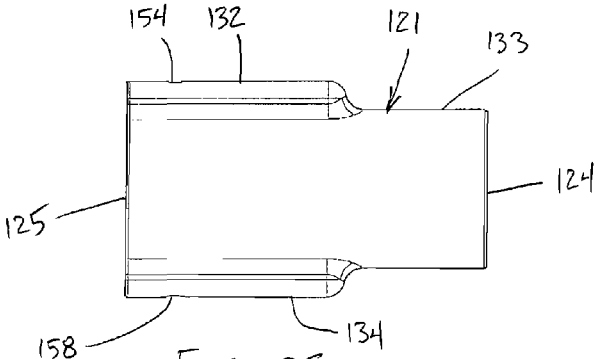
FIG. 35 is a side elevational view of the coupling member of FIG. 33 rotated 90 degrees about a longitudinal axis.

A hollow protrusion 132 extends outwardly from an outer surface 133 of the coupling member 120 and extends axially from the second end 127 to a position proximate the shelf 128, as shown in FIGS. 33-35. Two protrusions 132 and 134 are preferably diametrically opposed on the outer surface 133 of the coupling member 121, as shown in FIGS. 34 and 35-37. An inner diameter 137 of the inner surface 129 of the coupling member 121 is less than an inner diameter 138 between the protrusions 132 and 134, as shown in FIG. 36.

A fastener opening 154 is disposed in the protrusion 132, as shown in FIGS. 33 and 34. The fastener opening 154 extends entirely through the wall 173 such that an end of a fastener inserted therein is disposed in the passage 155. The fastener opening 154 is preferably threaded such that threads 156 extend through inner side walls 157 of the protrusion. A substantially similar fastener opening 158 is disposed in the second protrusion 134.

Figure 39:
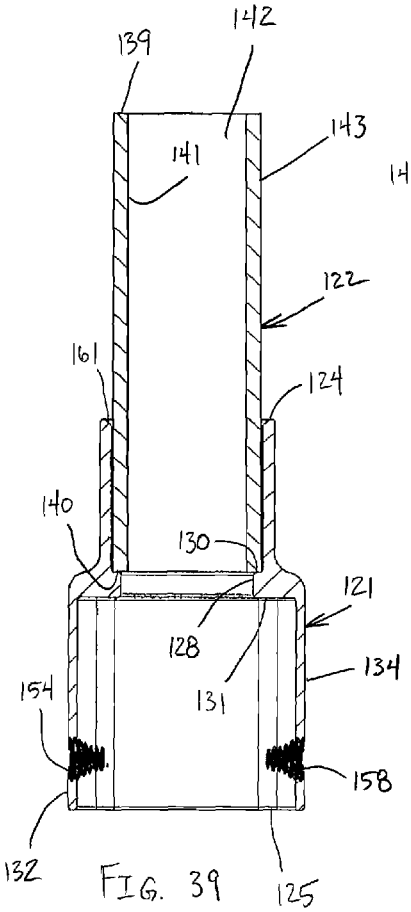
FIG. 39 is a side elevational view in cross-section taken along line 39-39 of the coupling member and first member of FIG. 38.

The first member 122, as shown in FIGS. 38-41, has a first end 139, a second end 140 and an outer surface 143 extending therebetween. As shown in FIG. 39, the first member 122 is preferably a hollow member. An inner surface 141 extends from the first end 139 to the second end 140 to form a passage 142 through the first member 122.

Figure 43:
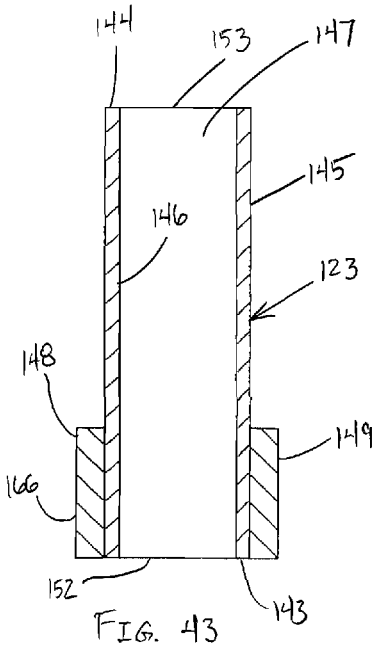
FIG. 43 is a side elevational view in cross-section taken along line 43-43 of the second member of FIG. 42.
Figure 42:
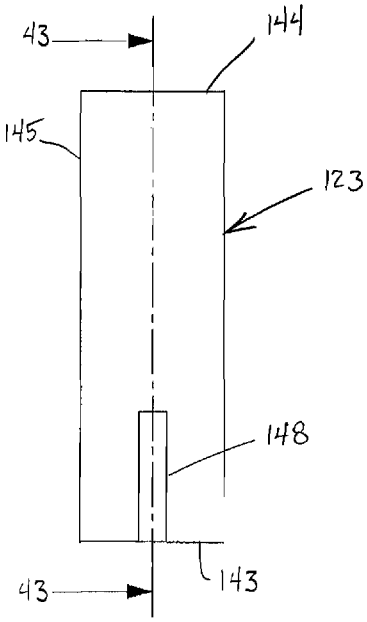
FIG. 42 is a front elevational view of the second member of FIG. 28.

The second member 123, as shown in FIGS. 42-45, has a first end 143, a second end 144 and an outer surface 145 extending therebetween. As shown in FIG. 43, the second member 123 is preferably a hollow member. An inner surface 146 extends from a first opening 152 at the first end 143 to a second opening 153 at the second end 144 to form a passage 147 through the second member 123.

Figure 44:
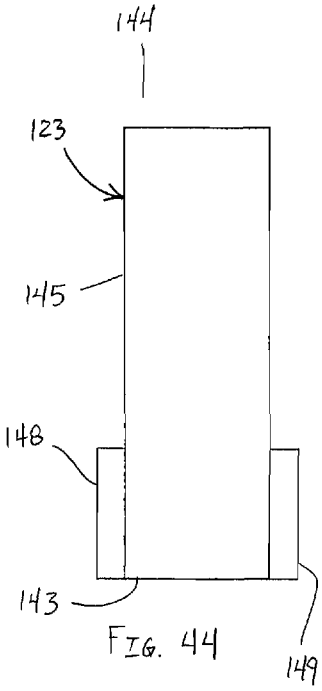
FIG. 44 is a side elevational view of the second member of FIG. 42 rotated 90 degrees about a longitudinal axis.
Figure 45:
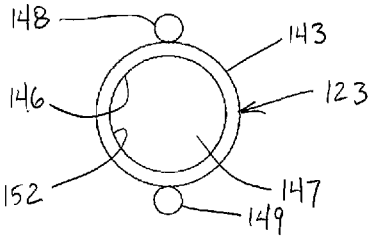
FIG. 45 is a bottom plan view of the second member of FIG. 42.
Figure 48:
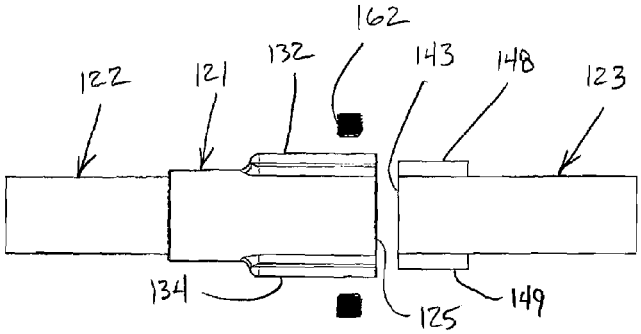
FIG. 48 is a side elevational view of the coupling member prior to receiving the second member of FIG. 46 rotated 90 degrees about a longitudinal axis.
Figure 46:
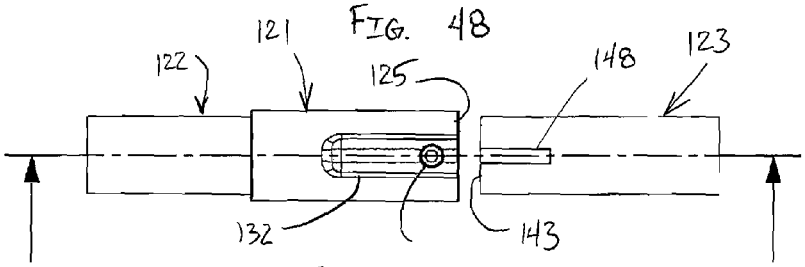
FIG. 46 is a front elevational view of the coupling member prior to receiving the second member of FIG. 28.
Figure 49:
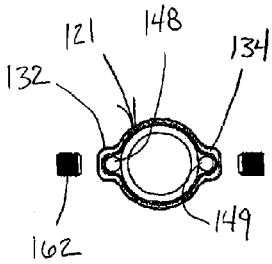
FIG. 49 is an end elevational view of the coupling member prior to receiving the second member of FIG. 46.
Figure 47:
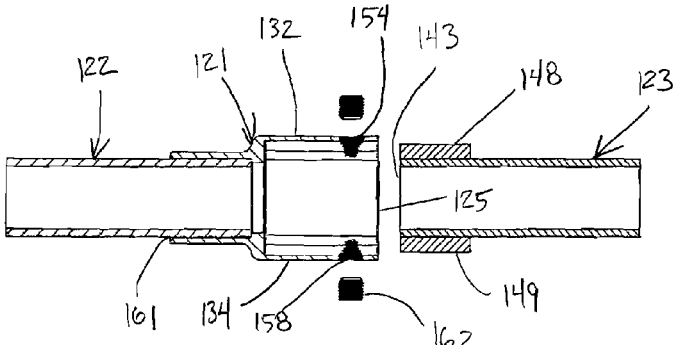
FIG. 47 is a side elevational view in cross-section taken along line 47-47 of the coupling member prior to receiving the second member of FIG. 46.

A first rib 148 is disposed on the outer surface 145 of the second member 123, as shown in FIGS. 42-45. The first rib 148 extends from the first end 143 axially along the outer surface 145 toward the second end 144. A second rib 149 is diametrically opposed from the first rib 148 on the outer surface 145 of the second member 123, as shown in FIGS. 43, 44 and 45. The ribs 148 and 149 are preferably welded to the second member 123 to securely fix the ribs to the second member, although the ribs can be connected in any suitable manner.

The coupling member 121 is preferably made of a metal, such as steel. The first and second members 122 and 123 are typically made of steel. Preferably, the coupling member 121 is made of the same material as the first and second members 122 and 123.

Assembly and Operation

The coupling assembly 120 in accordance with the second exemplary embodiment of the present invention provides a quick and easy connection between first and second members 122 and 123, as shown in FIGS. 28-32.

Figure 30:
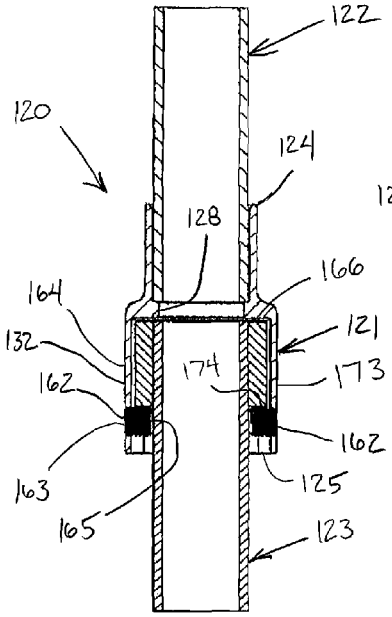
FIG. 30 is a side elevational view in cross-section taken along line 30-30 of the coupling member assembly of FIG. 29.
Figure 29:
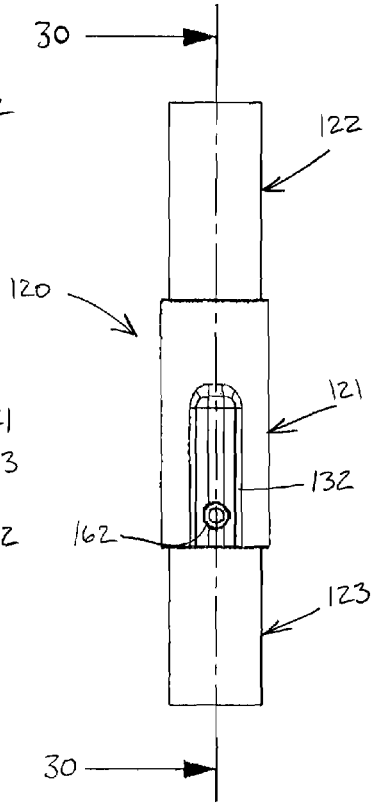
FIG. 29 is a is a front elevational view of the coupling member assembly of FIG. 28.
Figure 31:
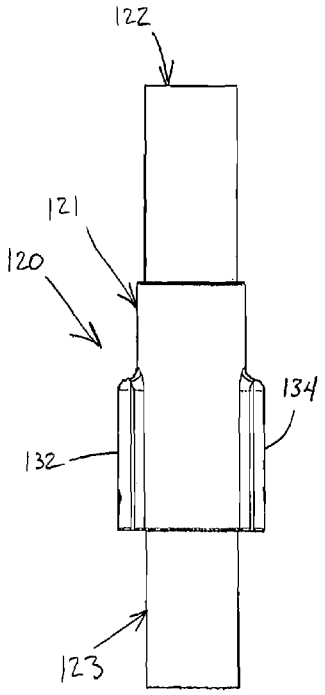
FIG. 31 is a side elevational view of the coupling member assembly of FIG. 29 rotated 90 degrees about a longitudinal axis.
Figure 32:
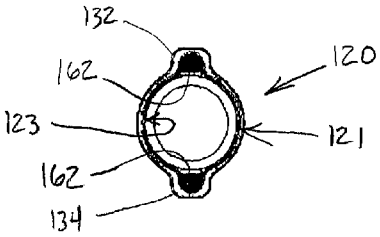
FIG. 32 is a bottom plan view of the coupling member assembly of FIG. 29.
Figure 38:
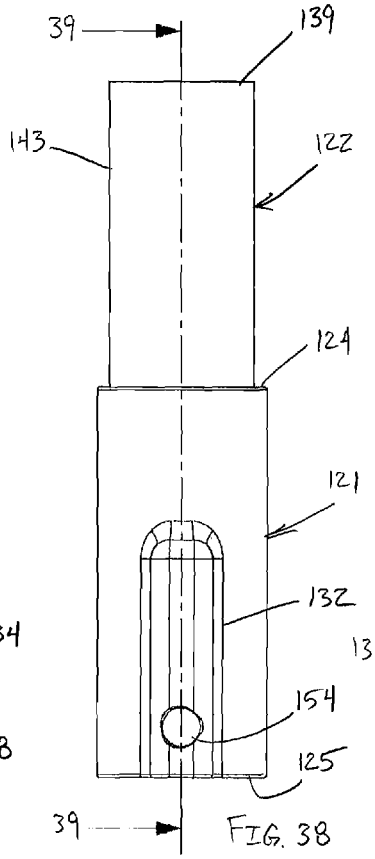
FIG. 38 is a front elevational view of the coupling member connected to the first member of FIG. 28.
Figure 40:
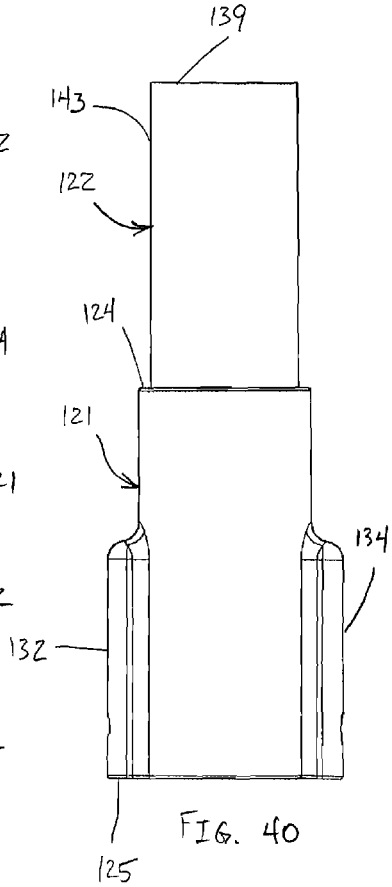
FIG. 40 is a side elevational view of the coupling member and first member of FIG. 38 rotated 90 degrees about a longitudinal axis.
Figure 41:
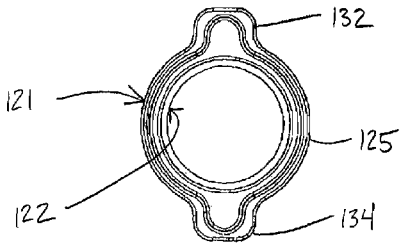
FIG. 41 is a bottom plan view of the coupling member and first member of FIG. 38.

The second end 140 of the first member 122 is inserted in the first opening 126 in the first end 124 of the coupling member 121, as shown in FIGS. 38-40. The first member 122 is inserted in the coupling member 121 until the first end 140 abuts the first shoulder 130 of the coupling member 121, thereby preventing further insertion of the first member 122. A bevel 161 is formed at the first end 124 of the coupling member, as shown in FIG. 39, to facilitate welding the first member 122 to the coupling member 121. As shown in FIGS. 30 and 39, an inner diameter of the shelf 128 is preferably larger than an inner diameter of the first member 122 such that the coupling member 121 does not obstruct any components being passed through the first member 122 and the coupling member 121.

The first end 143 of the second member 123 is aligned with the second end 125 of the coupling member 121, as shown in FIGS. 46-49. The second member 123 is positioned such that the ribs 148 and 149 are aligned with protrusions 132 and 134 of the coupling member 121. The first rib 148 is aligned with first protrusion 132 and the second rib 149 is aligned with the second protrusion 134 to facilitate insertion of the second member 123 in the coupling member 121.

The first end 143 of the second member 123 is inserted in the second opening 127 in the second end 125 of the coupling member 121, as shown in FIGS. 29-32. The second member 123 is inserted in the coupling member 121 until the first end 143 abuts the second shoulder 131 of the coupling member 121, thereby preventing further insertion of the second member 123. As shown in FIG. 30, the inner diameter of the shelf 128 is preferably larger than an inner diameter of the second member 123 such that the coupling member 121 does not obstruct any components being passed through the second member 123 and the coupling member 121.

Figure 28:
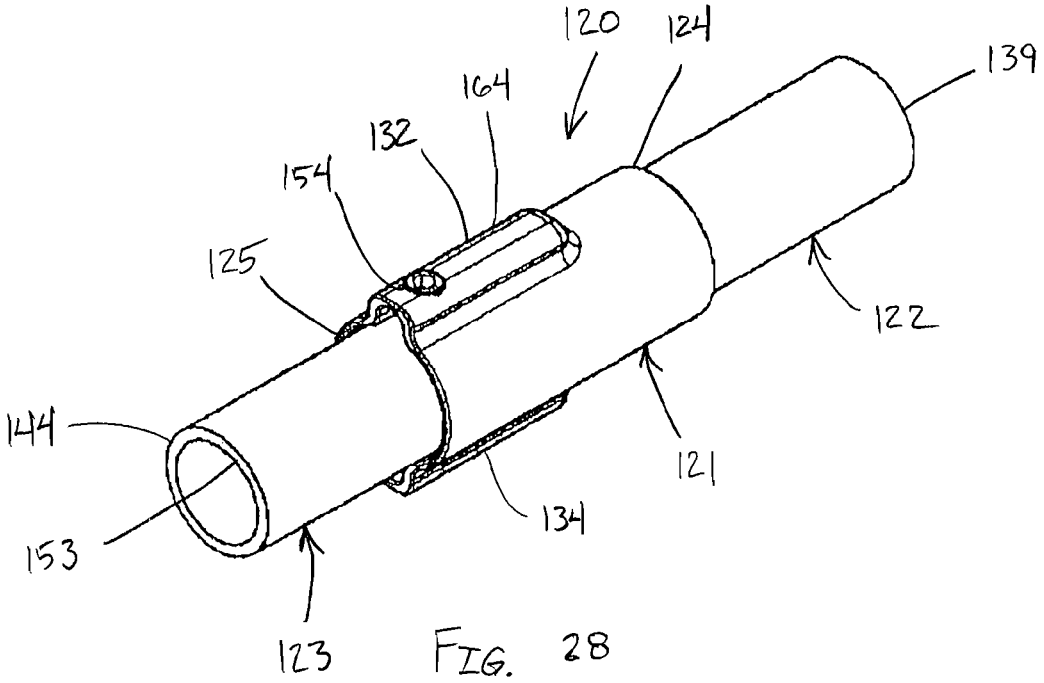
FIG. 28 is a perspective view of a coupling member assembly in accordance with a second exemplary embodiment of the present invention connecting first and second members.

A fastener 162 is disposed in each of the fastener openings 154 and 158 of the protrusions 132 and 134, as shown in FIGS. 29-32, to lock the second member 123 in the coupling member 121. The fasteners 162 are substantially identical. Any suitable fastener can be used, such as a set screw or bolt. An outer end 163 of the fastener 162 is preferably flush with an outer surface 164 of the protrusion 132, as shown in FIGS. 28 and 30. A low profile coupling assembly 120 is provided by not extending the outer end 163 of the fastener 162 beyond the outer surface 164 of the protrusions, thereby minimizing soil disturbance when installing a helical pile system in the ground. Alternatively, an outer end of the fastener, such as a bolt, can extend beyond the outer surface of the protrusions to increase soil disturbance when necessary or when soil disturbance is not an issue. Additionally, using a bolt as the fastener increases the tension strength of the coupling assembly 120. As shown in FIG. 34, the threads 156 of each fastener opening extend into the side surfaces 157 of the protrusions to reduce bending stress on the inserted fastener, thereby increasing the strength of the coupling assembly when the first and second members 122 and 123 are in tension.

An inner end 165 of the fastener 162 extends radially inwardly and against an axial end 174 of the rib remote from an end 166 of the rib inserted in the coupling member 121, thereby preventing withdrawal of the second member 123, as shown in FIG. 30. Accordingly, the fasteners only bear the relatively small forces to prevent separation of the second member 123 and the coupling member 121. Axial compressive and torque loads are borne by the interaction of the shoulders 130 and 131 of the coupling member 121 with the first and second members 122 and 123. As shown in FIG. 30, the inner diameter of the shelf 128 is greater than inner diameters of the first and second members 122 and 123 such that components can be passed through the coupling assembly 120 without interference from the coupling member 121 or fasteners 162.

During installation, torque is transferred from the first member 122 to the coupling member 121, and from the coupling member 121 to the second member 123 through the connection between the protrusions and ribs. Thus, torque is not transferred through fasteners and fastener holes that reduce torque capacity as in conventional coupling assemblies used in helical pile systems. Increased torque capabilities are obtained through the coupling assembly 120 of the present invention. Additionally, the ribs and protrusions are disposed at a greater distance (than the outer surfaces of the second member) from the center of rotation, thereby allowing for greater torque transfer. Compression is transferred directly through the first and second members 122 and 123 and the coupling member 121 by abutting the first and second members with the internal shoulders 130 and 131 of the coupling member, thereby improving the compressive load transfer. The ends of the first and second members 122 and 123 are disposed within the coupling member 121, thereby providing stiffness to the coupling assembly 120 resist buckling.

While advantageous embodiments have been chosen to illustrate the invention, it will be understood by those skilled in the art that various changes and modifications may be made therein without departing from the scope of the invention as defined in the appended claims and their equivalents.

What is claimed is:

1. A coupling assembly for a helical pile system, comprising:

a coupling member having a first opening at a first end and a second opening at a second end, the coupling member defining an axis extending between the first end and the second end, the coupling member including an outer surface;

an elongated hollow protrusion extending radially outwardly from said outer surface of said coupling member, the protrusion oriented parallel to the axis;

a fastener opening in said coupling member;

a first member fixedly receivable by said first opening of said coupling member;

a second member having a rib disposed on an outer surface, said rib being receivable by said protrusion when said second member is received by said second opening of said coupling member such that the protrusion extends along each side of the rib; and a fastener receivable in said fastener opening, said fastener abutting an end of the rib to prevent movement of said second member relative to said coupling member in a direction parallel to the axis.

2. The coupling assembly according to claim 1, wherein a first inner shoulder of said coupling member limits insertion of said first member.

3. The coupling assembly according to claim 2, wherein a second inner shoulder of said coupling member limits insertion of said second member.

4. The coupling assembly according to claim 3, wherein said fastener is disposed adjacent an end of said rib to prevent withdrawal of said second member when said second member is inserted in said coupling member such that axial compressive and torque loads are borne by interaction between said first and second inner shoulders of said coupling member and said first and second members and between said rib and said protrusion, respectively.

5. The coupling assembly according to claim 1, wherein said first and second members are hollow.

6. The coupling assembly according to claim 1, wherein an outer end of said fastener is substantially flush with said outer surface of said coupling member when received by said fastener opening.

7. The coupling assembly according to claim 1, wherein said first member is welded to said coupling member.

8. The coupling assembly according to claim 1, wherein said rib is welded to said outer surface of said second member.

9. The coupling assembly according to claim 1, wherein said first and second members have substantially equivalent inner diameters.

10. The coupling assembly according to claim 9, wherein no portion of said coupling member or said fastener extends radially inwardly of inner diameters of said first and second members when said first and second members are received by said coupling member.

11. The coupling assembly according to claim 1, wherein said second member has two ribs diametrically opposed on said outer surface.

12. The coupling assembly according to claim 1, wherein said second member has four ribs equally circumferentially spaced apart on said outer surface.

13. The coupling assembly according to claim 1, wherein said fastener opening is disposed in said protrusion.

14. The coupling assembly of claim 1, wherein the fastener includes an inner end abutting an outer surface of the second member.

15. A coupling assembly for a helical pile system, comprising:

a coupling member having a first opening and a second opening, the coupling member defining an axis extending between the first end and the second end, the coupling member including an outer surface;

an elongated hollow protrusion extending radially outwardly from said outer surface of said coupling member, the protrusion oriented parallel to the axis;

a fastener opening disposed in said protrusion of said coupling member;

a first member fixedly received by said first opening of said coupling member;

a second member received by said second opening of said coupling member;

a rib disposed on an outer surface of said second member and received by said protrusion of said coupling member such that the protrusion extends along each side of the rib; and a fastener received by said fastener opening, said fastener being disposed axially rearwardly of an end of said rib to prevent movement of said second member relative to said coupling member in a direction parallel to the axis.

16. The coupling assembly according to claim 15, wherein a first inner shoulder of said coupling member limits insertion of said first member and a second inner shoulder of said coupling member limits insertion of said second member such that axial compressive and torque loads are borne by interaction between said first and second inner shoulders of said coupling member and said first and second members and between said rib and said protrusion, respectively.

17. The coupling assembly according to claim 15, wherein an outer end of said fastener is substantially flush with said outer surface of said protrusion of said coupling member.

18. The coupling assembly according to claim 15, wherein no portion of said coupling member or said fastener extends radially inwardly of inner diameters of said first and second members.

19. The coupling assembly according to claim 15, wherein said fastener opening is threaded such that threads of said fastener opening extend along side walls of said protrusion.

20. A method of connecting first and second members of a helical pile system, comprising the steps of inserting the first member in a coupling member;

aligning a rib of the second member with a hollow protrusion of the coupling member;

inserting the second member in the coupling member such that the protrusion extends along the sides of the rib; and locking the second member in the coupling member with a fastener that is disposed adjacent a second end of the rib spaced apart from the first end to prevent movement of the second member relative to the coupling member in a direction parallel to the rib.

21. The method of connecting first and second members of a helical pile system according to claim 20, further comprising inserting the first member in the coupling member until the first member abuts a first internal shoulder of the coupling member; and inserting the second member in the coupling member until the second member abuts a second internal shoulder of the coupling member.

22. A coupling assembly for coupling a first member and a second member of a helical pile system, the coupling assembly comprising:

a coupling member including a first end, a second end, and an outer surface, the coupling member defining an axis extending between the first end and the second end, the first end including a first opening configured to receive a portion of the first member, the second end including a second opening configured to receive a portion of the second member, the coupling member including at least one fastener opening;

at least one elongated protrusion extending radially outwardly from the outer surface of the coupling member, each protrusion forming a hollow portion oriented parallel to the axis;

at least one rib configured to be secured to one of the first member and the second member, each rib including a first end, a second end, and a pair of sides extending between the first end and the second end, each rib at least partially positioned in the hollow portion of one of the at least one protrusion, the at least one protrusion extending along each side of the respective rib; and at least one fastener positioned in one of the at least one fastener openings, the fastener positioned adjacent the second end of the at least one rib to secure the coupling member against movement relative to the at least one rib.

23. The coupling assembly of claim 22, wherein the coupling member includes an inner surface and a first inner shoulder formed on the inner surface and extending around the axis, wherein the first inner shoulder is configured to contact an end of the first member inserted into the first opening.

24. The coupling assembly of claim 23, wherein the coupling assembly includes a second inner shoulder formed on the inner surface and extending around the axis, wherein the second inner shoulder is configured to contact an end of the second member inserted into the second opening, wherein the first inner shoulder and the second inner shoulder define an internal diameter that is configured to be no less than an internal diameter of the first member.

25. The coupling assembly of claim 22, wherein the at least one elongated protrusion includes a plurality of protrusions spaced apart about the axis at equal angular intervals.

26. The coupling assembly of claim 25, wherein the at least one rib includes a plurality of ribs spaced apart about the axis at equal angular intervals.

27. The coupling assembly of claim 26, wherein the plurality of protrusions includes two protrusions spaced apart from one another by 180 degrees about the axis, wherein the plurality of ribs includes two ribs spaced apart from one another by 180 degrees about the axis.

28. The coupling assembly of claim 26, wherein the plurality of protrusions includes four protrusions spaced apart from one another by 90 degrees about the axis, wherein the plurality of ribs includes four ribs spaced apart from one another by 90 degrees about the axis.

29. The coupling assembly of claim 22, wherein the at least one fastener includes an inner end configured to abut an outer surface of the second member.

* * * * *